United States Patent [19]

Sadler, III

[11] Patent Number: 4,652,270

[45] Date of Patent: Mar. 24, 1987

[54] PROCESS FOR PRODUCING LOW-VISCOSITY COAL-WATER AND LIGNITE-WATER MIXTURES AND COMPOSITIONS PRODUCED THEREBY

[75] Inventor: Leon Y. Sadler, III, Tuscaloosa, Ala.

[73] Assignee: The University of Alabama, Ala.

[21] Appl. No.: 751,182

[22] Filed: Jul. 2, 1985

[51] Int. Cl.[4] ..... C10L 1/32
[52] U.S. Cl. ..... 44/51
[58] Field of Search ..... 44/51

[56] References Cited

U.S. PATENT DOCUMENTS

| | | | |
|---|---|---|---|
| 3,492,225 | 1/1970 | Ryznar | 210/733 |
| 4,282,006 | 8/1981 | Funk | 44/51 |
| 4,441,888 | 4/1984 | Matt et al. | 44/51 |

*Primary Examiner*—Mrs. Y. Harris-Smith
*Attorney, Agent, or Firm*—Oblon, Fisher, Spivak, McClelland & Maier

[57] ABSTRACT

A method of producing a stable, flowable carbonaceous-solid/water mixture, which comprises contacting a particulate carbonaceous solid and water mixture comprising a solid phase and an aqueous phase with an ion exchange material unit the conductivity of the aqueous phase is substantially reduced and removing the ion exchange material from the mixture, is disclosed.

20 Claims, 15 Drawing Figures

PROCESS FOR PRODUCING LOW-VISCOSITY COAL-WATER AND LIGNITE-WATER MIXTURES AND COMPOSITIONS PRODUCED THEREBY

BACKGROUND OF THE INVENTION

1. Field of the Invention

This invention relates to stablized water slurries of carbonaceous materials and more particularly to coal-water and lignite-water mixtures.

2. Description of the Prior Art

The United States and many other nations of the world have large energy reserves in the form of coal and other carbonaceous solid materials. Although the cost of coal and other solid fuels is generally relatively low at the mine site, energy consuming centers are often distantly removed from the energy sources. Accordingly, transportation costs typically form a significant fraction of the cost of using coal and other carbonaceous fuels, such as lignite.

In order to reduce transportation costs, pipelines capable of pumping coal-water slurries have been proposed. Two commercial-scale coal slurry pipelines have been constructed in the United States. One of these, the 273-mile Black Mesa Pipeline in Arizona and Nevada, is now transporting 4 million tons per year of coal from a mine in Nevada to a power plant in New Mexico. A number of other slurry pipelines, including the proposed 1670 mile ETSI pipeline to be built to carry 37,500 tons per year of coal from Gillette, Wyo. to Pine Bluff, Ark., are in various stages of design or negotiation.

The combustion of coal- or lignite-water mixtures as substitute fuel for increasingly expensive petroleum is also the subject of considerable research and development activity. Experimentation has progressed from the laboratory to tests in industrial-scale boilers, direct-fired heaters and electric power generation facilities.

For both slurry transport and CWM combustion, raw coal is crushed and blended with 30 to 50% additional water to produce a stable, pumpable mixture. The maximum coal particle size at the Black Mesa operation is approximately 2 mm, and nearly 20% is purposely crushed to less than 44 microns. This fine size fraction is necessary to produce, with the water present, a "vehicle" to minimize sedimentation of the coarser size fractions. In a typical CWM, the maximum particle diameter is approximately 150 microns, and approximately 80% of the particles have diameters less than about 75 microns. In both applications (transport and combustion), every effort is made to minimize the amount of water used, since in the case of direct combustion of CWM, an energy penalty is paid for the presence of water, and too high a water content causes problems in maintaining a stable flame. In the case of slurry pipelining, water may be scarce at the slurry preparation site, separation of water from the coal at the pipeline terminus is expensive, disposal of slurry water may pose environmental problems, and transportation of this "inert" material adds to pumping costs.

However, aqueous slurries of finely ground coal containing over 65 wt. % solids are currently difficult to pump. It is well know that the apparent viscosity of a concentrated CWM at a given shear rate is not linearly related to the solids fraction. As the solids content approaches that corresponding to dense packing, further small increases in solids content greatly increase the viscosity and thus the pumping costs and reducing porability. In the CWM, this phenomena is observed at a solids content of about 65% by weight. Although these problems can be avoided by decreasing the weight percent of solids, a high water content is undesirable, as is discussed above.

Interest in both the transportation of coal by slurry pipeline and in the direct combustion of coalwater mixtures (CWM) has reached a high level in recent years. The development of similar technology for lignite-water slurries and suspensions is lagging far behind that of coal. This lag is primarily due to the high water-to-solids ratio required of lignite-water mixtures (LWM) that are to be pumped at reasonable energy cost or that are to be used as a substitute for oil in process heating.

U.S. Pat. No. 4,282,006 discloses pipeline pumped high-solids content, coal-water slurries. These slurries may be generally characterized as having a Brookfield viscosity of about 2,000 cps or less at 60 rpm at about 75 wt. %, dry basis, coal content. The primary factor contributing to high solids content and fluidity is said to be the particle size distribution of the slurries, although dispersing agents and/or electrolytes are also used in the preparation of these slurries.

U.S. Pat. No. 4,417,902 describes a process for the production of coal-water slurries by the incorporation therein of a prescribed group of additives. These additives reduce viscosities at high rates of applied shear. The additives are selected from $\beta$-substituted carboxylic acids, dialkanol alkyl amines, and diamines of lower molecular weight dissolved or dispersed in the slurry.

U.S. Pat. No. 4,436,528 also discloses the use of dispersants to decrease viscosity but additionally includes a water-soluble polymer selected from specified alginates and gums.

U.S. Pat. No. 4,441,888 also describes a coal slurry containing a dispersing agent and a water-soluble polymer, but uses a olefin/maleic acid copolymer as the water-soluble polymer.

U.S. Pat. No. 4,457,762 describes a coal-water slurry containing a condensation product formed from arylphenol sulfonic acids and related compounds.

The cited patents are representative of a larger group of patents which describes the production of stabilized water slurries of carbonaceous materials. Two approaches have generally been taken to produce a high solids content while retaining low viscosity. One involves the careful optimization of the coal particle size distribution. For a given solids content, the particle size distribution that gives the lowest mixture viscosity appears to be one that has a broad range of particle sizes. The other method used to minimize viscosity involves the use of chemical additives for dispersion and stabilization of the suspension. The cost of these additives, typically a hydrocarbon-based carboxylic acid or xanthan gum, are in the range of $5 to $15 per ton of coal-water mixture (CWM). Because of the high added expense of dispersants (relative to total fuel price) and because of the difficulty in accurately controlling particle size distribution at the pipeline head, additional means for controlling the viscosity of coal-water and lignite-water slurries remain needed.

SUMMARY OF THE INVENTION

Accordingly, it is an object of the present invention to provide a method of producing a stable, flowable carbonaceous solid and water mixture without requiring close control of particle size or the use of additives.

It is a further object of this invention to provide a method of producing a stable, flowable carbonaceous solid and water mixture which, in combination with control of particle size or use of an additive, results in even lower viscosities than would otherwise be attainable.

This and other objects of the invention as will hereinafter become more readily apparent have been accomplished by providing a method of producing a stable, flowable carbonaceous solid and water mixture, which comprises contacting a particulate carbonaceous solid and water mixture, comprising a solid phase and an aqueous phase, with an ion exchange material until the conductivity of the aqueous phase is substantially reduced and removing the ion exchange material from the mixture. The flowable carbonaceous solid and water mixture produced using this method is also part of the present invention.

BRIEF DESCRIPTION OF THE DRAWINGS

A more complete appreciation of the invention and many of the attendant advantages thereof will be readily obtained by reference to the following detailed description when considered in connection with the accompanying drawings, wherein.

DESCRIPTION OF THE PREFERRED EMBODIMENTS

Figure 1:
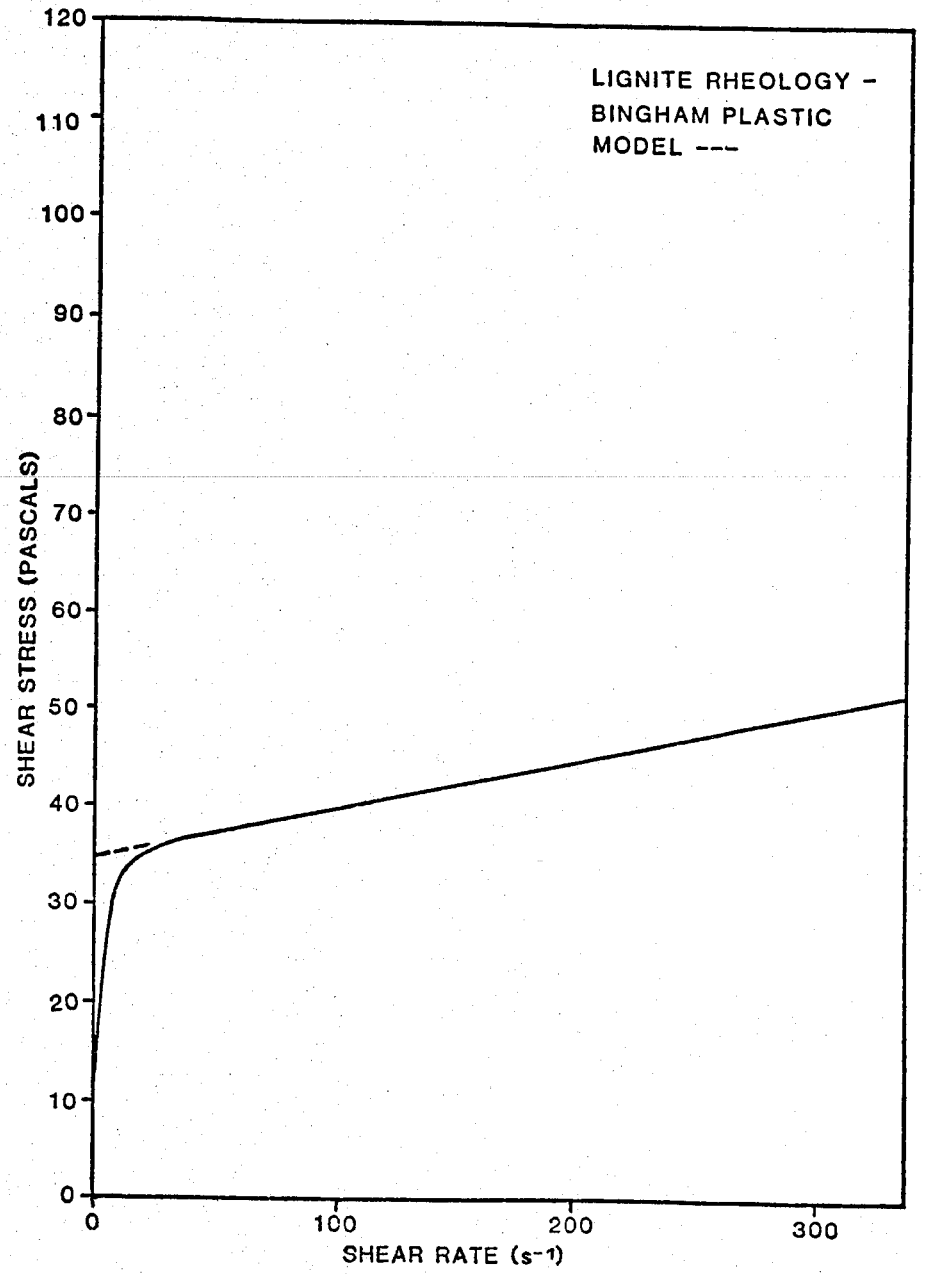
FIG. 1 is a rheogram of an unwashed lignite-water mixture.

In earlier work with lignite-water mixtures (LWM) by the inventor, marked differences were found in the effect various surfactants had on the rheology of LWM. Rheology was found to depend strongly on the origin of the lignite specimen used to prepare the LWM. Lignite specimens (Table 1) obtained from three different locations in the Alabama lignite belt were used to prepare concentrated mixtures in these experiments. While the heating value, proximate analyses, and water-to-dry lignite ratios were essentially the same for each LWM, there were significant differences in the chemistries of the aqueous phases. The LWM having low dissolved solids contents were responsive to treatment with viscosity-reducing additives, while LWM produced from the other lignites were essentially unresponsive to such treatment. This earlier work has been continued, and it has now been demonstrated that removal of naturally occurring, water-soluble compounds from a CWM or an LWM offer a third method for lowering the viscosity and raising the solids content, in addition to particle size control and use of dispersants.

TABLE 1

| LIGNITE PROPERTIES | Lignite | | |
|---|---|---|---|
| | A | B | C |
| Source of Specimen | Railroad cut Sumter County, Alabama | Outcrop in a Creek Marengo County, Alabama | Main Seam-Test Mining Pit Choctaw County Alabama |
| Heating value, Btu $lb^{-1}$ | 5,730 | 5,180 | 5,406 |
| Proximate Analysis: | | | |
| Moisture, % | 44.4 | 48.2 | 47.0 |
| Volatile matter, % | 24.4 | 24.2 | 22.1 |
| Fixed carbon, % | 24.5 | 21.5 | 22.0 |
| Ash, % | 6.7 | 6.1 | 8.9 |
| Properties of Aqueous Phase of 30% Solids Suspension: | | | |
| Total Dissolved Solids, mg $l^{-1}$ | 5,900 | 10,100 | 11,700 |
| Aluminum, mg $l^{-1}$ | 148 | 543 | 273 |
| Calcium, mg $l^{-1}$ | 918 | 984 | 826 |
| Sodium, mg $l^{-1}$ | 1,620 | 1,370 | 1,970 |
| Potassium, mg $l^{-1}$ | 23.8 | 22.6 | 8.7 |
| Hardness, mg $l^{-1}$ | 1,500 | 900 | 1,400 |
| Chloride, mg $l^{-1}$ | 1,500 | 3,000 | 1,000 |
| Acidity, mg $l^{-1}$ | 4,000 | 5,700 | 6,000 |

Water-soluble inorganic compounds naturally present in lignite were found to be responsible for high-viscosity behavior of concentrated (57% asreceived lignite or 32% dry lignite) lignite-water mixtures (LWM). The cations $Ca^{++}$, $Mg^{++}$, $Al^{+++}$, $Mn^{++}$, $Fe^{++}/Fe^{+++}$, $K^{+}$, and $Na^{+}$ were found to be present in the aqueous phase of freshly-prepared LWM in amounts ranging from 456 ppm of $Ca^{++}$ to 8 ppm of $Na^{+}$. The $SO_4^{2-}$ anion was found to be present at approximately the 4000 ppm level, and the aqueous phase conductivity was $4.5\times10^{-3}$ mho. Ion chromatographic analyses of the aqueous phase failed to reveal significant amounts of dissoved organic compounds. The lignite particle size ranged from 10 to 60 microns. No attempt was made to optimize the particle size distribution. The LWM were found to behave as Bingham plastic fluids.

When the water-soluble compounds were removed by repeated washing with deionized water from the aqueous phase of the freshly-prepared LWM, the apparent viscosity of the LWM at a shear rate of 50 $S^{-1}$, for example, was reduced by a factor of more than 15. This dramatic reduction in viscosity was reproduced readily whenever the conductivity was reduced to below $3\times10^{-4}$ mhos by washing.

It was found that trivalent cations have a larger effect on LWM rheology than do divalent cations, and divalent cations have a larger effect than monovalent $SO_4^{4-}$ was also found to have a large effect. Zeta potential determination proved to be difficult, but values were found to be negative in both washed and unwashed mixtures.

Use of cation and anion exchange resin treatment to remove water-soluble compounds from freshly-prepared LWM was found to be even more effective in lowering viscosity than washing with deionized water. A process with commercial applications for producing low-viscosity/high-solids LWM and CWM that utilizes these findings in concert with particle size distribution control was devised from these findings.

The process of the invention comprises contacting a mixture of water and a particulate carbonaceous solid with one or more ion exchange materials until the conductivity of the aqueous phase is substantially reduced, preferrably to less than $10^{-3}$ mhos. The ion exchange material is then removed from the mixture to give a stable, flowable carbonaceous-solid/water mixture capable of being pumped through a pipeline or atomized into a boiler as a "liquid fuel" with maximum efficiency. There is no need, or a reduced need, using the method of the invention, to add any additional materials to the mixture, such as the dispersants or suspending agents previously used.

The carbonaceous solid used in the practice of the invention is preferably coal or lignite. Other carbonaceous solids, such as peat and combustible sludges, can also be used in the practice of the invention. The carbonaceous solid is reduced to a particulate form using any suitable method, such as wet-ball or rod milling, wet grinding in fluidcontaining mills, or dry grinding in ring roller mills, ball or race mills, or cage mills followed by dispersion in the liquid medium.

Control of particle size distribution is important in obtaining minimum viscosity. Methods prior to the present invention have relied heavily on the careful optimization of the coal particle size distribution. For a given solids content, the particle size distribution that gives the lowest mixture viscosity is one that has a broad range of particle sizes. For a given maximum particle size, the optimum particle size distribution can be calculated using methods described in the literature. Particles larger than about 300 microns are impractical from a combustibility standpoint, and particles smaller than 1 micron require too much grinding energy to produce. Guidance in selecting suitable particle size distributions can be found in the patents cited in the prior art section of this application, which are herein incorporated by reference.

In general, coal, lignite, and other carbonaceous solids can be reduced to particles in a similar fashion.

When a water slurry is prepared of the particulate carbonaceous solid, low viscosity is of particular importance, and a solids content of at least 50% is preferred, more preferably at least 65%. The water used to form the aqueous phase of the mixture preferably contains a minimum amount of dissolved solids. It is preferred that the conductivity of the water be less than $10^{-4}$ mho prior to use in forming the slurry. Furthermore, the water used should have low concentrations of divalent and trivalent cations and of divalent anions. As is pointed out in this specification, such multivalent ions have a greater ability to increase viscosity than do monovalent ions. Accordingly, for any given level of conductivity, water containing lesser concentrations of divalent and trivalent ions are preferred.

The solid ion exchange material contacted with the mixture preferably comprises a cation exchange material capable of exchanging hydrogen ions for other positively charged ions (cations) in the mixture or an anion exchange material capable of exchanging hydroxide ions for other negatively charged ions (anions) in the mixture. Hydrogen ions introduced into the mixture from the cation exchange resin react with hydroxide ions, such as those present from dissolved magnesium or calcium hydroxide, to produce water, thereby reducing the conductivity of the aqueous phase. Hydroxide ions released by the anion exchange material are likewise capable of reducing conductivity by reacting with hydrogen ions naturally present in the aqueous phase. In a preferred embodiment of the invention, both a cation exchange material and an anion exchange material are used. The cation exchange material replaces positively charged ions present in the slurry, such as calcium, magnesium, aluminum, manganese, and iron ions, with hydrogen ions. The anion exchange material replaces negatively charged ions, such as sulfate and chloride ions, with hydroxide ions, which then react with the hydrogen ions obtained from the cation exchange material to produce water.

The nature of the cation and anion exchange materials is unimportant as long as they may readily be separated from both the solid phase and the liquid phase of the mixture and as long as they readily remove the multivalent ions from solution. Ion exchange materials having a high capacity for the exchanged ions are particularly preferred. Other preferred characteristics are ease of regeneration with mineral acids or sodium hydroxide solutions and good mechanical stability. Accordingly, solid ion exchange materials rather than soluble compounds are essential, unless the soluble material can be removed, such as by an insolubilization or precipitation process. Preferred are ion exchange resins having a particle size different from that of the particulate carbonaceous material, which allows separation of the carbonaceous solid from the ion exchange solid by a simple filtration or screening process. For example, when lignite particle sizes in a lignite-water mixture are between 5 and 60 microns, ion exchange resins in the form of particles having a size sufficient to be retained on a 48 mesh (Tyler) screen, having opening of approximately 300 microns in size, can readily be separated from the carbonaceous solid.

The following table, while not intended to be comprehensive, lists suitable ion exchange materials that can be used in the practice of this invention

ION EXCHANGE MATERIALS

Cation Exchange Materials zeolites
montmorillonites
acrylic acid polymers
methacrylic acid polymers
sulfonated styrene copolymers

Anion Exchange Materials epichlorohydrin-amine condensates
styrene-DVB-based copolymers
Type I (reaction product of trimethylamine with copolymer after chloromethylation)

Type II (reaction production of dimethylethanolamine with copolymer after chloromethylation)

Ion exchange materials are well known and are readily available on a commercial basis. Accordingly, they need not be discussed here in detail since the structure is generally immaterial to the practice of this invention. Many review articles that describe ion exchange materials in detail are available, should such references be needed by those with little background in ion exchange materials. An extensive review of the preparation, use, and theory of ion exchange materials is given, for example, in the Kirk-Othmer Encyclopedia of Chemical Technology, volume 13, pages 678–705, John Wiley & Sons, New York, 1981, which is herein incorporated by reference. This article also points out additional publications indicative of the level of skill existing in the art, which can be turned to for reference if desired. Furthermore, many technical bulletins are available from the manufacturers of ion exchange materials that fully describe the known characteristics of the commercially available materials that are likely to be used in the practice of this invention.

Although many ion exchange materials of inorganic origin are known (see the Table above and the Kirk-Othmer article), ion exchange materials based on organic resins represent preferred materials for use in the present invention. These resins are generally polymers or copolymers of styrene with functionalization of the aromatic groups or are polymers or copolymers of acrylic or methacrylic acid. Typically, cation exchange resins have sulfonate or carboxylate functional groups, preferably sulfonate groups, and anion exchange resins have amine functional groups, ranging from primary to quaternary amines. Industrial quantities of ion exchange resins are available from many sources. For example, Dow Chemical Company provides cation and anion exchange resins under the tradename Dowex in bulk quantities, as does Rohm and Haas Company under the tradename Amberlite.

Since ion exchange materials can readily be regenerated into the original $H^+$ and $OH^-$ forms, the amount of ion exchange material contacted with a given amount of carbonaceous-solid/water mixture depends principally on the convenience of the process used. If only a small amount of ion exchange material is used, it will have to be regenerated into its original form more often, whereas if a larger amount is used, regeneration will be less frequent. A need for regeneration can readily be detected by measuring the conductivity of the aqueous phase as it leaves contact with the ion exchange material. If conductivity has been reduced to a desired level at a given flow rate or contact time and conductivity begins to increase (as the ion exchange capacity of the resin is lost), regeneration should take place.

Contact time can likewise be readily determined by those carrying out the process. Generally, the person producing the flowable carbonaceous solid and water mixture can readily determine the amount of contact time from the viscosity of the product produced. For example, a pipeline operator will typically be able to determine appropriate viscosities by measuring, for example, energy consumption of pumps, speed of flow for a given pumping rate, or pressure buildup in the pipeline. Contact time, and a corresponding reduction in viscosity by an increase in the amount of ions removed, can be increased until the adverse condition is relieved. As a general guideline for establishing initial parameters of contact, the contact can be maintained until the conductivity of the aqueous phase reaches a level of less than $10^{-3}$ mhos, preferably less than $6\times10^{-4}$ mhos, and most preferably less than $3\times10^{-4}$ mhos. If contact time for a given amount of ion exchange resin is undesirably long, contact time can be reduced by increasing the amount of ion exchange material present or increasing the surface area of the ion exchange material.

As is evident from the above, the parameters of contact time, amount of ion exchange material, and regeneration frequency are most readily determined by an operator producing the flowable carbonaceous-solid/water mixture. Once a suitable composition has been found by routine experimentation, routine operating procedures can be established. For example, if conductivity of a particular level produces the desired result, operation can be controlled by measuring the conductivity of the aqueous phase of the mixture as it leaves contact with the ion exchange material. If the conductivity is too high, conductivity can be lowered by increasing the contact time, increasing the relative amount of ion exchange material to mixture and/or regenerating the hydrogen or hydroxide form of the ion exchange material.

Reduction in viscosity as a result of the contacting described herein results in significant savings in energy consumption for CWM and LWM transportation. The pressure drop for hydraulic transport of a slurry can be broken down into two terms: the pressure drop due to the fluid phase and the pressure drop due to the slurry particles. When there are particles present that are much finer than the "typical" slurry particles, the liquid/very fine particle system can be considered to be the "fluid phase." Calculations, based on an article by Molerus and Welman, "A New Concept for the Calculation of Pressure Drop with Hydraulic Transport of Solids in Horizontal Pipes," Chem. Eng. Sci. Vol. 38, 1981, pp. 1623–1632, showed that an increase in the viscosity of the fluid phase from 10 to 100 cp would result in a four-fold increase in slurry pressure drop (and in power consumption).

It is recognized that treatment of a carbonaceous solid/water mixture may have to occur on several occasions during a pumping operation, particularly if the carbonaceous solid remains in contact with the aqueous phase for extended periods of time (days or longer). Additional ions are leached into the aqueous phase from the carbonaceous solid, raising conductivity and destabilizing the suspension. Accordingly, if a carbonaceous-solid/water mixture is to be pumped over a period of several days, it is preferred that treatment of the mixture with ion exchange materials to reduce conductivity as described herein take place sufficiently often to maintain the desired level of conductivity of the aqueous phase. Normally, contact more often than once every 12 to 24 hours is not required.

An important use of the carbonaceous solid and water mixture is as a substitute for liquid fuels such as fuel oil. If the water content is relatively low, a mixture of carbonaceous solids and water can readily be burned without removal of the water. Since heat is required to vaporize the water, however, the highest possible solids content is preferred. Thus, the method of the present invention provides a means for maintaining high solids content and aiding in utilization of coal and other solid fuels in "liquid" fuel oilers and other energy consuming-heat generating apparatuses.

Compositions of the invention comprising a flowable carbonaceous-solid/water mixture offer several advantages over those compositions previously prepared and described in the patents and other publications mentioned in this specification. The compositions initially contain no artificial additives, such as dispersants or suspending agents. Accordingly, the composition is less expensive to produce than the compositions containing such agents, which typically add 5 to 10 dollars cost to each ton of pumpable material. Any environmental or corrosion effects caused by the presence of dispersants or suspending agents in the aqueous phase, which may be removed at the energy consumption site, are also eliminated. Also, particle size distribution control, while it should still be practiced in order to reduce viscosity to the maximum extent possible, will be less critical than previously. The ion exchange materials used in the practice of the invention undergo a highly reversible reaction and can be reused many times so that once the initial expense of the ion exchange materials is recovered, additional treatment can occur without cost for additional materials, except cost of regenerating fluids (typically industrial-grade acids and bases), which are typically much less expensive than dispersants or suspending agents.

Figure 15:
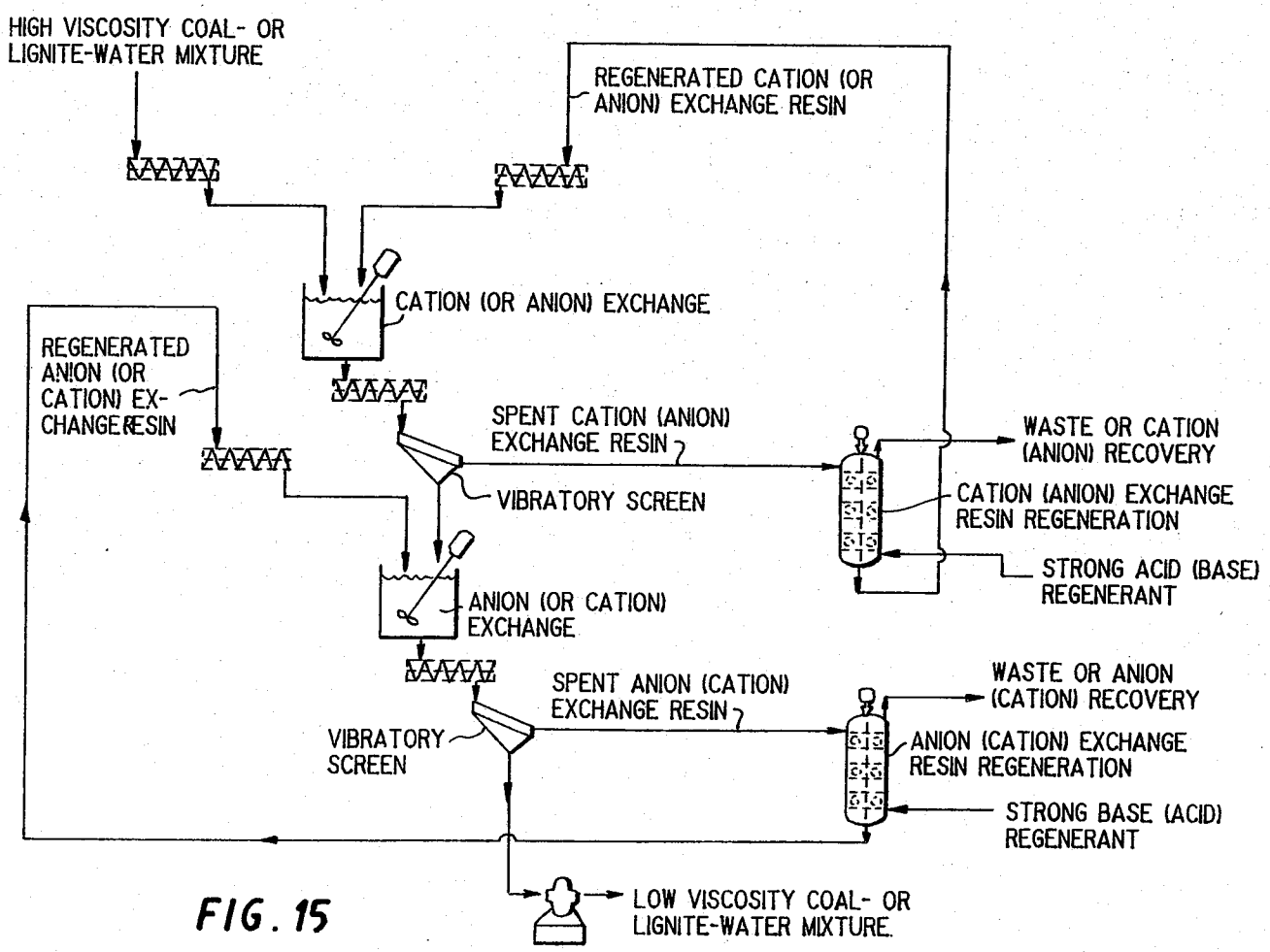
FIG. 15 is a flow diagram showing a process for mixture conditioning using ion exchange resins.

Although the process of the invention can be carried out in a variety of different fashions, a typical process of a preferred embodiment is shown in schematic form in FIG. 15 and in the following description. A high viscosity coal- or lignite-water mixture, prepared using standard procedures, is added to a large tank or other vessel equipped with an agitator. For the remainder of this description, the mixture will be referred to as a coal-water mixture or as CWM for ease of expression. A cation exchange resin having particle sizes larger than the particles of the carbonaceous solid is added to the vessel. In this example, it is assumed that cation exchange resin will be used initially. However, it is readily apparent that anion exchange resin can be used first, followed by cation exchange resin.

After a sufficient period of contact between the components in the mixing vessel, the mixture of coal, water, and resin particles is transported to a vibratory screen, which separates the 3-component mixture into two parts, a first part comprising the spent cation exchange resin, which does not pass through the screen, and a second part comprises the coal-water mixture, now having hydrogen ions in place of the original positively charged ions. This coal-water mixture is then transported to a second mixing vessel where an anion exchange resin is added, and contact is maintained for a suitable period of time. The 3-component mixture is then transported to a second vibratory screen, which separates the spent anion exchange resin from the coal-water mixture, which now has a low viscosity. The various spent ion exchange materials are transported to recovery vessels, where they are regenerated and returned to the appropriate contacting steps.

Another means for carrying out the invention is to use a resin that has a much higher density than the carbonaceous particles and to utilize this density difference in the separation technique. For example, metal spheres with an ion-exchange resin coating could be used. Apparatuses for separating particles according to density are well known and need not be described here in detail. Examples include mixer/settler-type processing apparatuses and liquid cyclone separators.

A third example of carrying out the process would be to use a stationary or fixed-bed ion exchange material. The fixed bed could consist of a honeycomb structure or a stack of closely spaced parallel plates. The ion exchange material would form or be coated on the surface of the stationary structure. The CWM would then be pumped continuously through the stationary bed containing the ion exchange material. When operated in a continuous manner in this fashion, two stationary beds would be present for each type of resin (cation or anion) used. One bed would be in operation while the other bed was being regenerated.

Many means for selectively adsorbing or absorbing ions or other materials in solutions or suspensions are already known for use in other processes, such as desalination, water softening, and the like. Such processes could readily be adapted to the practice of the present invention using the description set forth in this specification.

The process of the invention has been experimentally demonstrated using a lignite-water mixture. Lignite-water mixtures containing approximately 32% solids were prepared from an Alabama lignite by wet ball milling. Lignite particle sizes in the mixture were between 5 and 60 microns. Repeated washing of the first lignite-water mixture with deionized water brought about a 7-fold reduction in apparent viscosity at 10 $S^{-1}$ and a 5-fold decrease at 200 $S^{-1}$. In a second sample, there was a 7-fold decrease at 10 $S^{-1}$ and a 6-fold decrease at 200 $S^{-1}$. This large decrease in apparent viscosity was correlated both with a large decrease in the concentration of sulfate anion and with decreases in the concentration of the cations calcium, magnesium, aluminum, and manganese.

A stable suspension appeared when the conductivity had been reduced by washing to less than $6\times10^{-4}$ mhos. The appearance of this suspension, in both samples, coincided with the greatest reduction in lignite-water mixture consistency. Using ion exchange resins to decrease concentration in the aqueous phase produced a 100-fold drop in apparent viscosity at 10 $S^{-1}$ and a 24-fold decrease at 200 $S^{-1}$. These decreases, which were obtained in a single treatment step, were significantly greater than the decreases produced by washing multiple times.

The invention now being generally described, the same will be better understood by reference to the following example, which is included for purposes of illustration only and is not intended to be limiting of the invention or any embodiment thereof, unless so specified.

EXAMPLE

Preparation of a Low-Viscosity Lignite-Water Mixture

Discussion

Approach

Water-soluble ions were washed from the lignite-water mixtures (LWM) and identified, and the rheology of the LWM, before and after washing, was characterized. The effect of each of the more abundant ions was then determined by viscosity measurements after its readdition to the LWS. Effects of pH, ion conductivity, and solids content were also monitored. Finally, LWM rheology was studied after ion exchange resins were used to remove soluble ions from the aqueous phase.

Materials

A 3-ton lignite sample was taken from a much larger sample recovered from the main seam test mining pit operated by Consolidated Coal Company in Choctaw County, Alabama. From this sample, two representative 10 lb. samples were chosen, crushed with a mortar and pestle, passed through a Tyler 6 mesh screen, and stored in airtight plastic containers inside airtight plastic bags. A silicone fluid viscosity standard of 480 cP (at 25° C.) was obtained from the Brookfield Engineering Laboratories. Amberlite ion exchange resins IR-120 Plus (cation) and IRA-400 (anion) were supplied by the Rohm and Haas Company. The cation resin, supplied in $Na^+$ form, had a size range of 14 to 48 mesh (Tyler) with less than 0.7% fines. The anion resin ($Cl^-$ form) had the same particle range with less than 3% fines (through 48 mesh). The cation exchange resin was described by Rohm and Haas as having a greater affinity for trivalent and divalent cations than for monovalent cations.

Equipment

A couette-type viscometer (Fann model 39B) with thermal bath and a Houston Instrument 2000 x-y recorder were used to characterize LWM rheology. A dionex 2020i ion chromatograph (AS-4 column and post-column fiber suppression) was used in the identification of water soluble anions. Chemical analysis was performed on the LWM supernatant by Tuscaloosa Testing Labs using the ICAP (Inductively Coupled Ion Plasma) 9000. For grinding the lignite, a two-liter ceramic ball mill with roller drive (¾" and ½" and ½" stainless steel balls) was used. A Cole Parmer 1481 ion conductivity meter and Corning 5 pH meter were used for conductivity and pH measurements. Zeta potentials were measured with a Zeta-meter.

Procedure

Sample Preparation. The solids content of raw lignite was determined by drying at 110° C. in a laboratory oven until weights became constant (approximately 24 hours), assuring accuracy in solids content to within 0.1%. Three hundred grams (44% solids) of raw lignite, 300 grams of deionized (18 megaohm) water, and 1600 grams of each ball size (¾" and ½") were charged to the mill and ground for 30 minutes. The LWM was removed from the mill, separated from the balls using a coarse screen, and then divided into two samples: a control sample and a test sample. The control sample was left unwashed while the test sample, 200 gms of approximately 50 weight-percent lignite, was suspended in deionized water (between 20 and 100 ml) and then centrifuged at 1100×g for 20 minutes. After the clear, colorless supernatant was removed, this proces was repeated until a colloidal suspension appeared which was stable at maximum centrifugation (1750×g).

Rheology Determination. The moisture contents of the control and test LWM was determined by drying a weighed representative sample at 110° C. for 24 hours. The moisture content was adjusted to between 30% and 34% solids by adding deionized water, and the mixture was stirred until it was uniformly suspended. The cup of the viscometer was filled to the mark and then allowed to equilibrate to 25° C. using the thermal bath. Viscosity standards were run after each sample determination, and a second moisture content determintaion was performed as a check. Except for a small nonlinear portion at low shear rates, the rheograms closely approximated the Bingham plastic model. A typical rheogram is shown in FIG. 1. A straight edge was used to extrapolate the linear portion (dashed line) of the curve to zero shear rate. This procedure was followed in all the rheograms presented in this study.

Identification and Determintaion of Anions. The supernatants were analyzed with the ion chromatograph using a conductivity cell as the detector. Anions were eluted with 0.0028M $NaHCO_3$/0.0022M $Na_2CO_3$ at 30° C. and a volumetric flowrate of 2 ml/min. To regenerate the AS-4 column, 0.025N $H_2SO_4$ was used.

Particle Size Distribution and Total Chemical Analyses. Total chemical analyses of the supernatant from the 1st, 12th, and 26th washings were performed by Tuscaloosa Testing Laboratory. The particle size distribution analyses were performed on a contact basis by Leeds and Northrup, Inc. using the Microtrac particle-size-distribution analyzer. Determinations were made on the control and on the test sample (after repeated washings), as well as on a separately ground sample.

Removal of Ions with Ion Exchange Resin. The cation exchange resin was changed to the $H^+$ form using 200 ml of 30% HCl for each 400 ml of resin in a 500 ml glass column at an acid flowrate of 50 ml/min. The resin was then washed with deionized water until the conductivity of the eluent was less than $1\times10^{-5}$ mhos. The anion resin was changed to the hydroxyl form using 200 ml of 1N NaOH to 200 ml of resin at a flowrate of 10 ml/min. The resin was washed with deionized water until the conductivity fell below $1\times10^{-5}$ mhos. Prior to treatment with ion exchange resin, a freshly ground batch of LWM was screened through a 48 mesh (Tyler) screen, and a rheogram was run to characterized rheology. Two hundred grams of cation resin was added to 100 grams of LWM. The cation resin was retained on a 48-mesh screen while the LWM was washed through with deionized water. Use of a small vibrating table facilitated separation. Two hundred grams of anion resin was then mixed with the LWM and allowed to equilibrate overnight. After anion resin separation by screening, the LWM was heated to 60° C. to remove excess water acquired during the screening process.

RESULTS

Part I—Identification and Removal of Ions

Twenty-six washings were performed on the LWM, with rheograms taken after the 4th, 8th, 12th, 24th, and 26th washings. The supernatants in the earlier washings were clear and colorless, but the one from the 24th washing was discolored, and the one from the 26th washing was opaque, indicating that a colloidal dispersion had formed.

Figure 2:
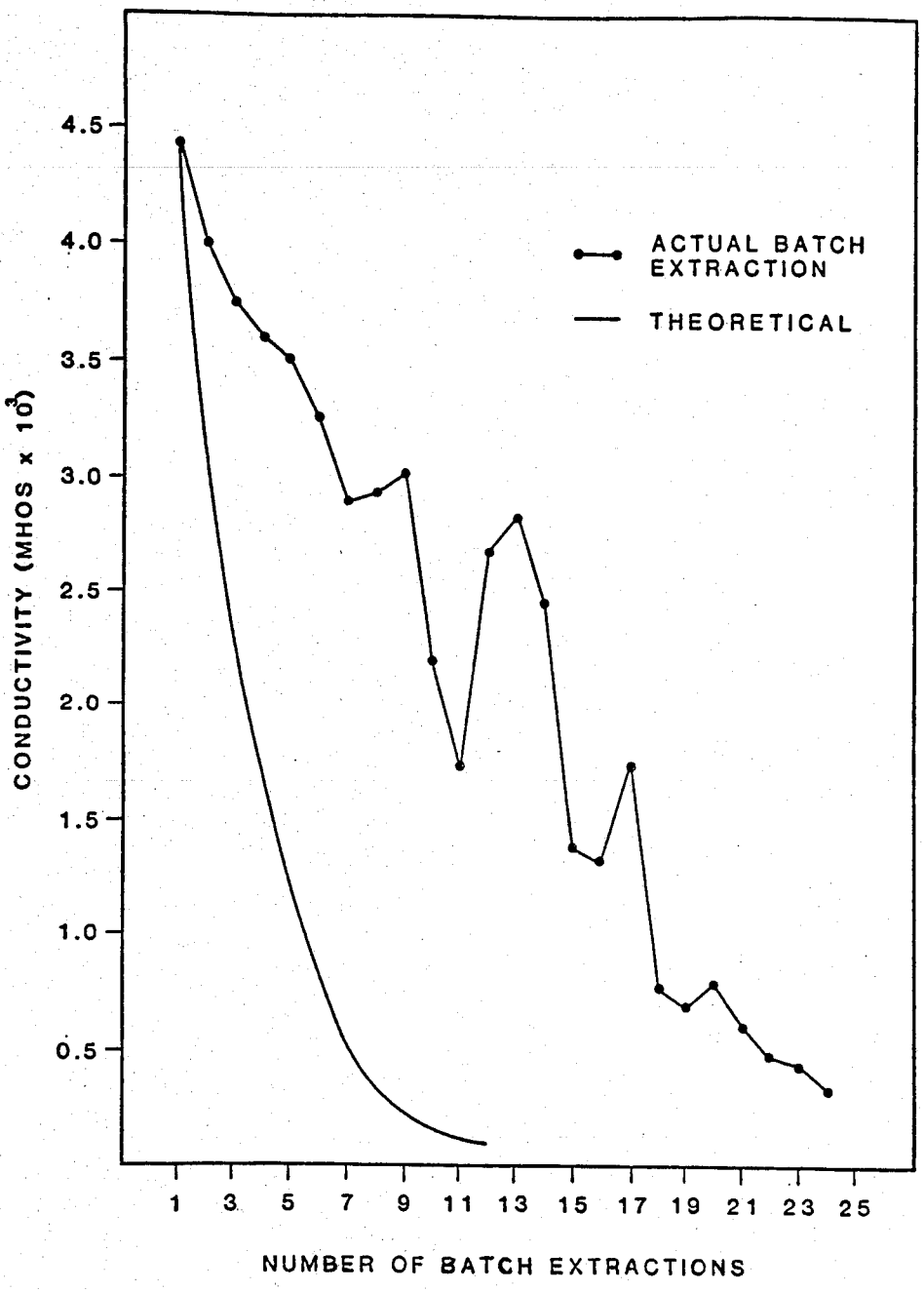
FIG. 2 is a conductivity profile of a lignite-water mixture measured at each step throughout a multistep washing process.
Figure 3:
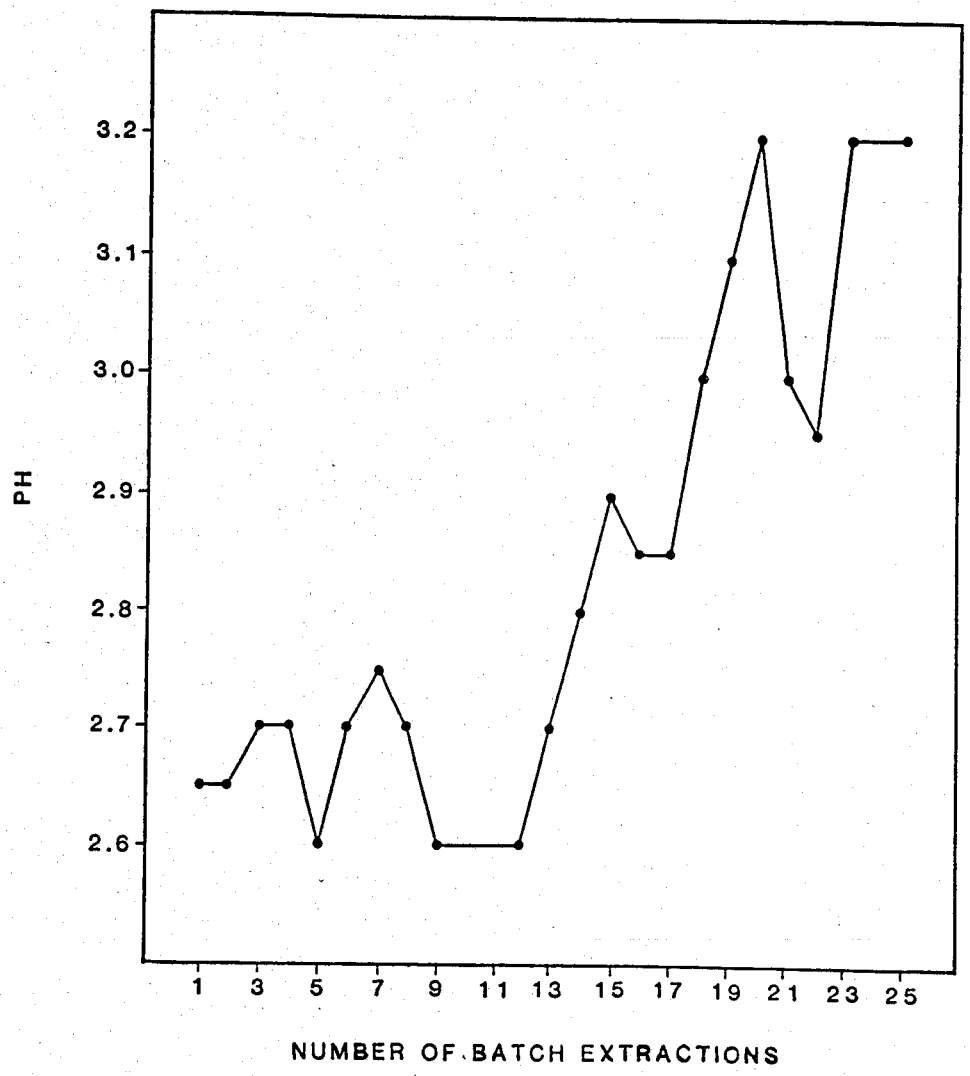
FIG. 3 is a pH profile of the mixture measured throughout the washing process.

The conductivity, pH, and sulfate concentrations in the supernatant were monitored after each washing. The conductivity profile (FIG. 2), ranging from $4.64\times10^{-3}$ mhos to $3.6\times10^{-4}$ mhos, shows a great deal of scatter. The scatter most likely was caused by slow leaching of slightly soluble compounds from the lignite into the aqueous phase. This process is time dependent, and since the time between washing was not held constant, "spikes" in the profile are apparent for long time lapses between washings. The lower line is a plot of the calculated conductivity versus the number of washings for the case where the water-soluble species is completely soluble and is perfectly mixed. The pH profile (FIG. 3) shows much smaller changes, but it does have the same obvious "spikes" as the conductivity profile.

Figure 4:
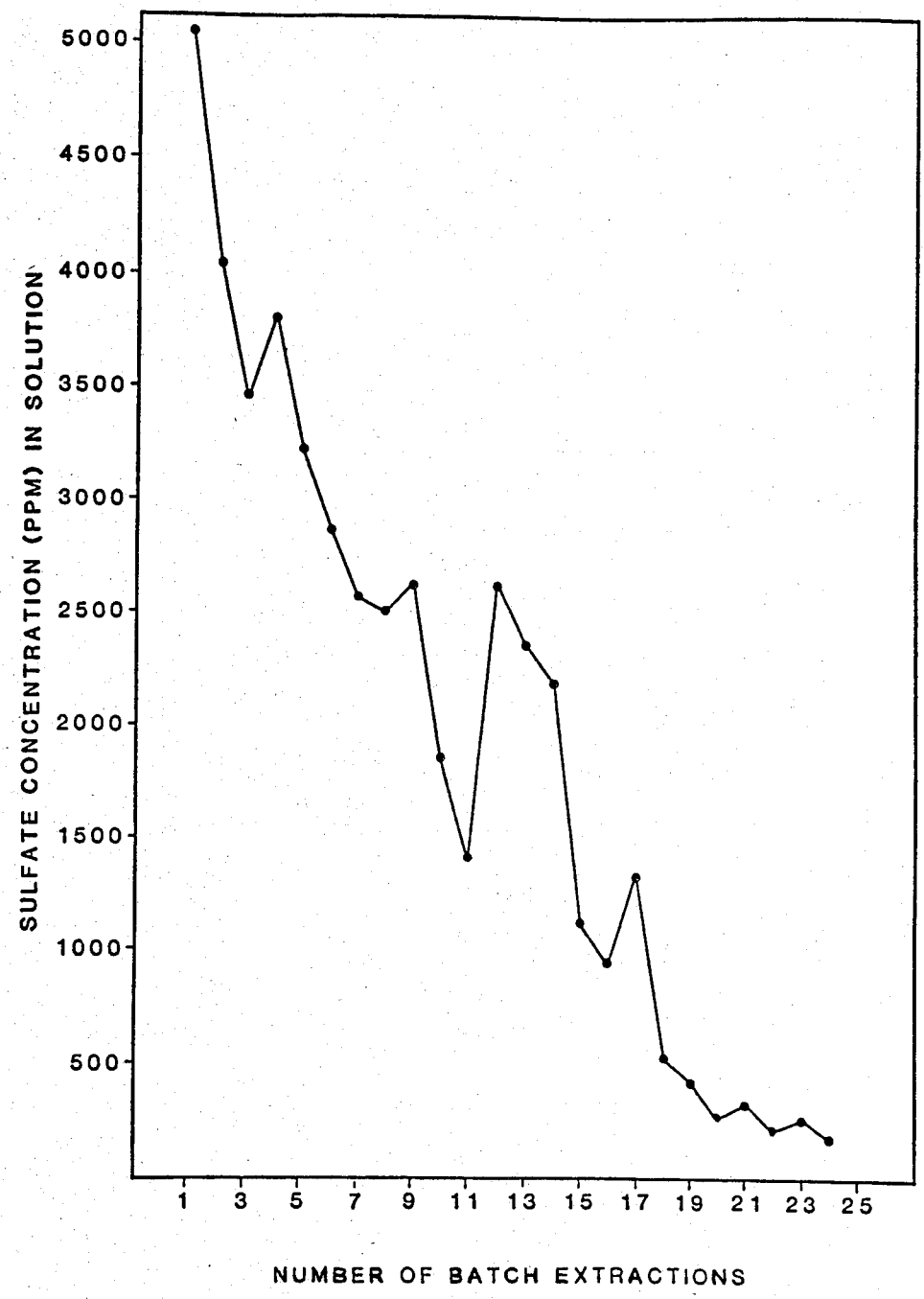
FIG. 4 is a graphical presentation of sulfate concentration of the mixture measured throughout the washing process.

Anion analyses of the water from each washing showed a substantial sulfate peak (4.5 min. retention time at 2.0 ml/min.) and traces of chloride (3.0 min. retention time). No other anion peaks were evident. The sulfate concentration shows the same "spikes" as did the conductivity and pH profiles (FIG. 4). Total chemical analyses of the supernatants were performed on the 1st, 12th, and 25th washings (Table 2). The major elements found were sulfur, calcium, magnesium, aluminum, manganese, and iron. Comparing the concentration of sulfur (1336 mg/l) from the 1st washing and the concentration of sulfate (5010 ppm) from the 1st washing suggests that most of the sulfur present was in the form of sulfate. The calcium concentration, unlike the concentration of the other cations, showed little decrease between the 1st and 12th extraction, but had dropped significantly by the 25th washing. This is consistent with the low solubility of $CaSO_4$ (0.2099 g/100 ml $H_2O$ at 30° C.).

TABLE 2

CHEMICAL ANALYSIS OF AQUEOUS WASHING

| Element | Concentration in the Supernatant (mg/l) 1st Washing | 12th Washing | 25th Washing |
|---|---|---|---|
| Sulfur | 1336 | 1263 | 70.7 |
| Calcium | 546 | 439 | 63.7 |
| Magnesium | 419 | 35.3 | <0.05 |
| Aluminum | 76.3 | 7.61 | 0.15 |
| Manganese | 50.0 | 5.06 | 0.12 |
| Iron | 44.8 | 82.0 | 1.49 |
| Silicon | 24.3 | 3.25 | 1.07 |
| Boron | 13.1 | 0.93 | 0.21 |
| Potassium | 8.6 | 0.76 | <0.50 |
| Sodium | 8.2 | <1.0 | <1.0 |
| Zinc | 2.2 | 2.39 | 0.62 |
| Chromium | 0.25 | <0.05 | <0.05 |
| Nickel | 0.16 | 1.11 | 0.20 |

Figure 5:
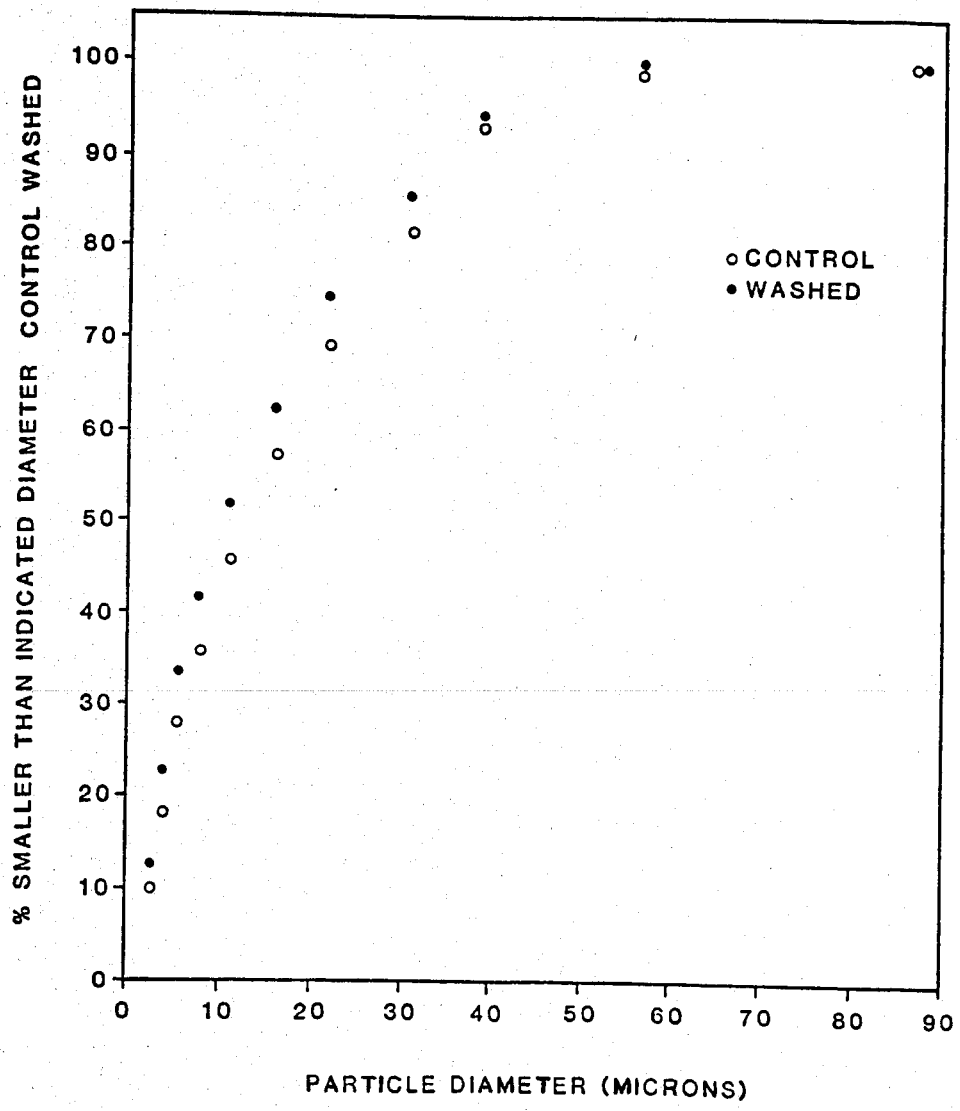
FIG. 5 is a graphical presentation of particle size distribution of control and test fractions at the end of the washing process.
Figure 6:
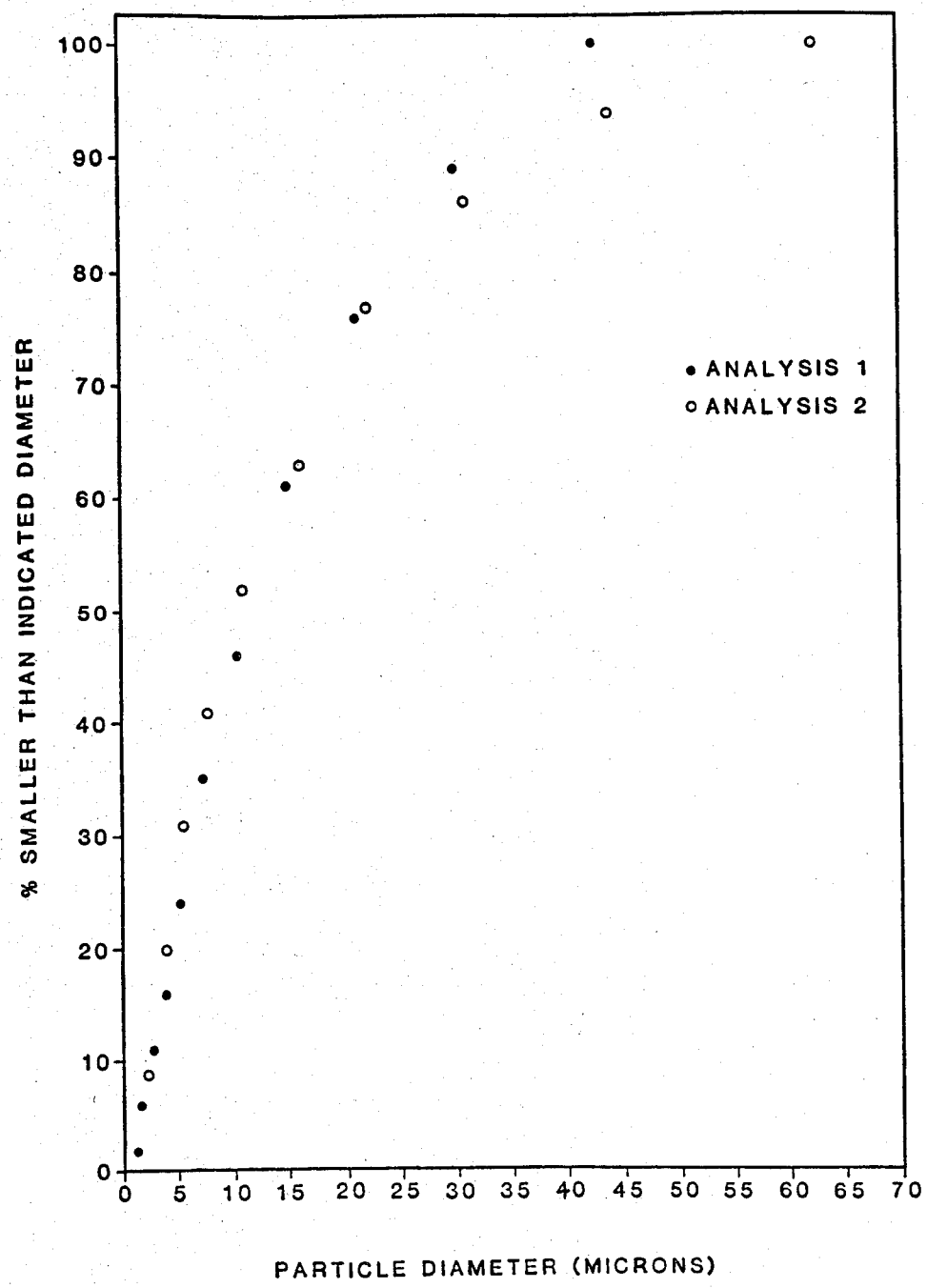
FIG. 6 is a graphical representation of replicate analyses for particle size on the same sample.

Particle size distribution analyses (FIG. 5), performed on the control and test fraction (after 26 washings), showed that the particle size distribution was not changed significantly by the washing process. FIG. 6 gives the results of replicate analyses of the same sample and shows that the small variation observed between the control and test samples seen in FIG. 5 could be due to instrument error. The particle size distribution shows that all particles are smaller than 90 microns, which is well within the range reported by others. Zeta potentials measured on lignite particles suspended in supernatant from the 1st, 24th and 26th washings gave values of −75 mV, −12.15 mV and −24 mV, respectively, but the validity of these values is somewhat questionable because other supernatants in the series would not yield consistent Zeta potentials, even after numerous trials.

Figure 7:
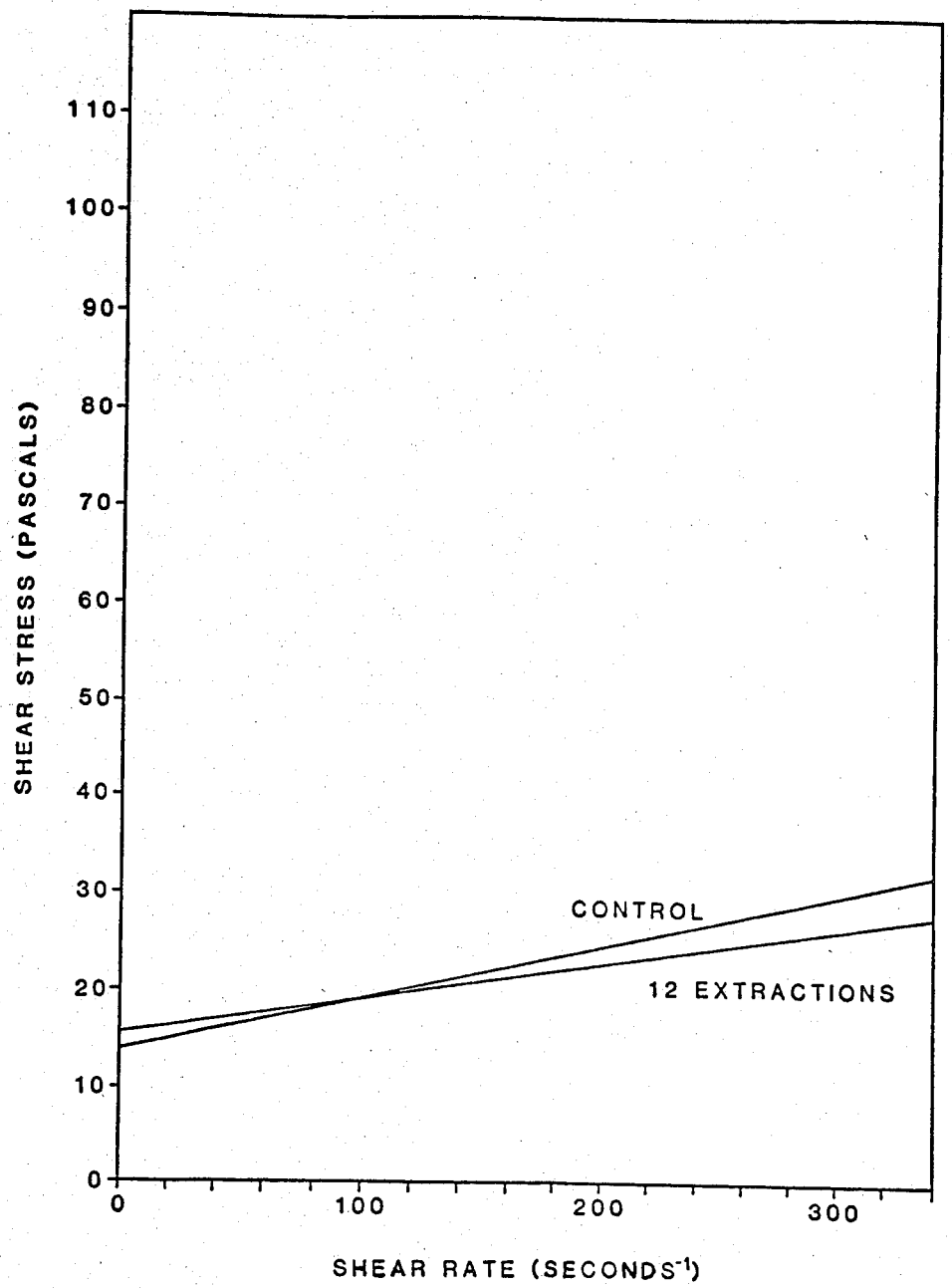
FIG. 7 is a graphical presentation of viscosity at an intermediate washing step.
Figure 8:
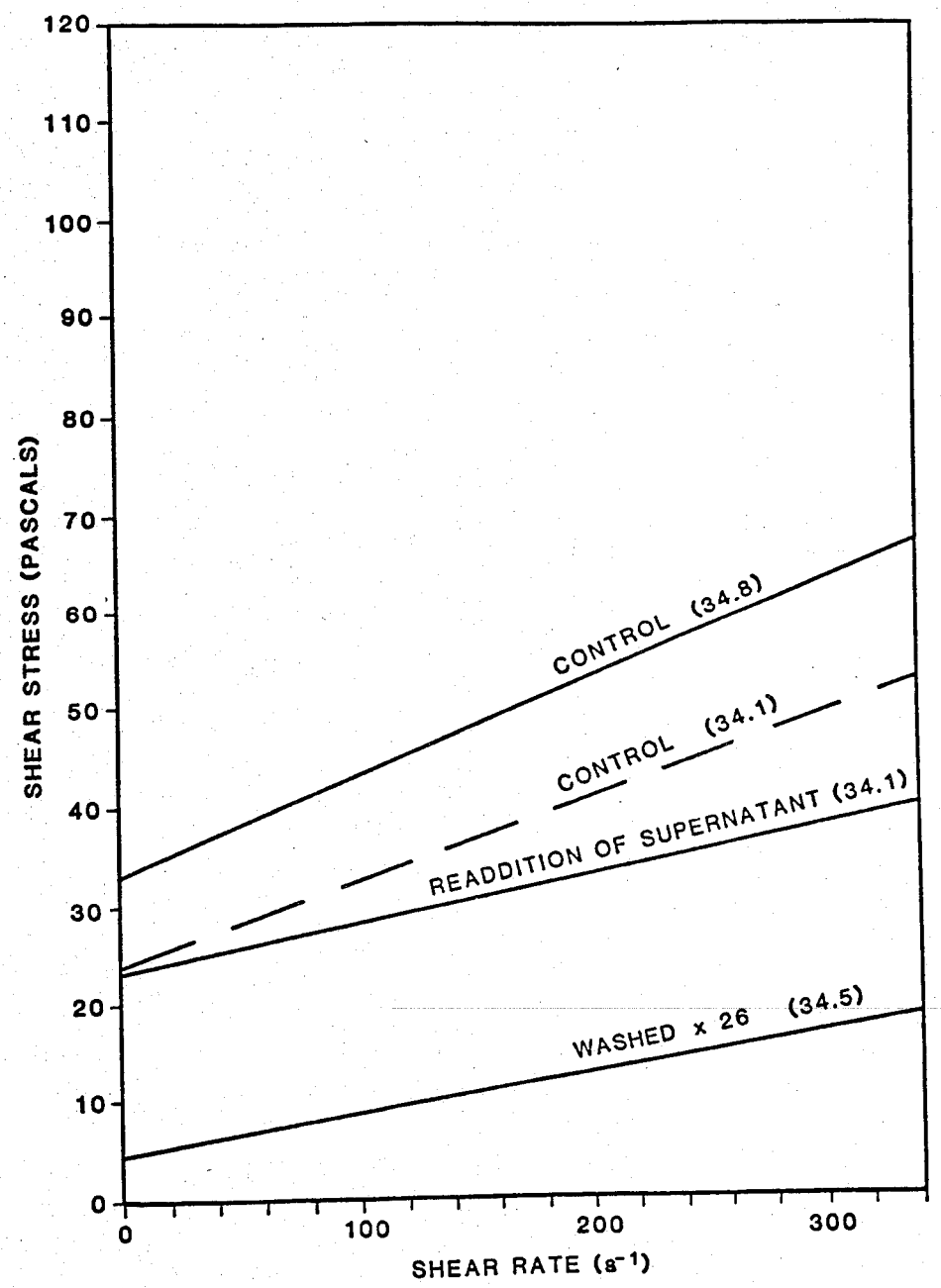
FIG. 8 is a graphical presentation of viscosity at the end of the washing process.

Before the 24th washing, all rheograms comparing control and test samples showed essentially no difference. The rheogram shown in FIG. 7, taken after the 12th washing, is typical. After the 24th washing there was a drop in the viscosity, and this change became more pronounced after the 26th washing (FIG. 8). Further washings were impossible since the suspension was too stable for centrifugation to separate the supernatant from the solids. Conservation of all particles was necessary to preserve the original particle size distribution to assure rheological changes did not result from a change in size distribution.

Figure 9:
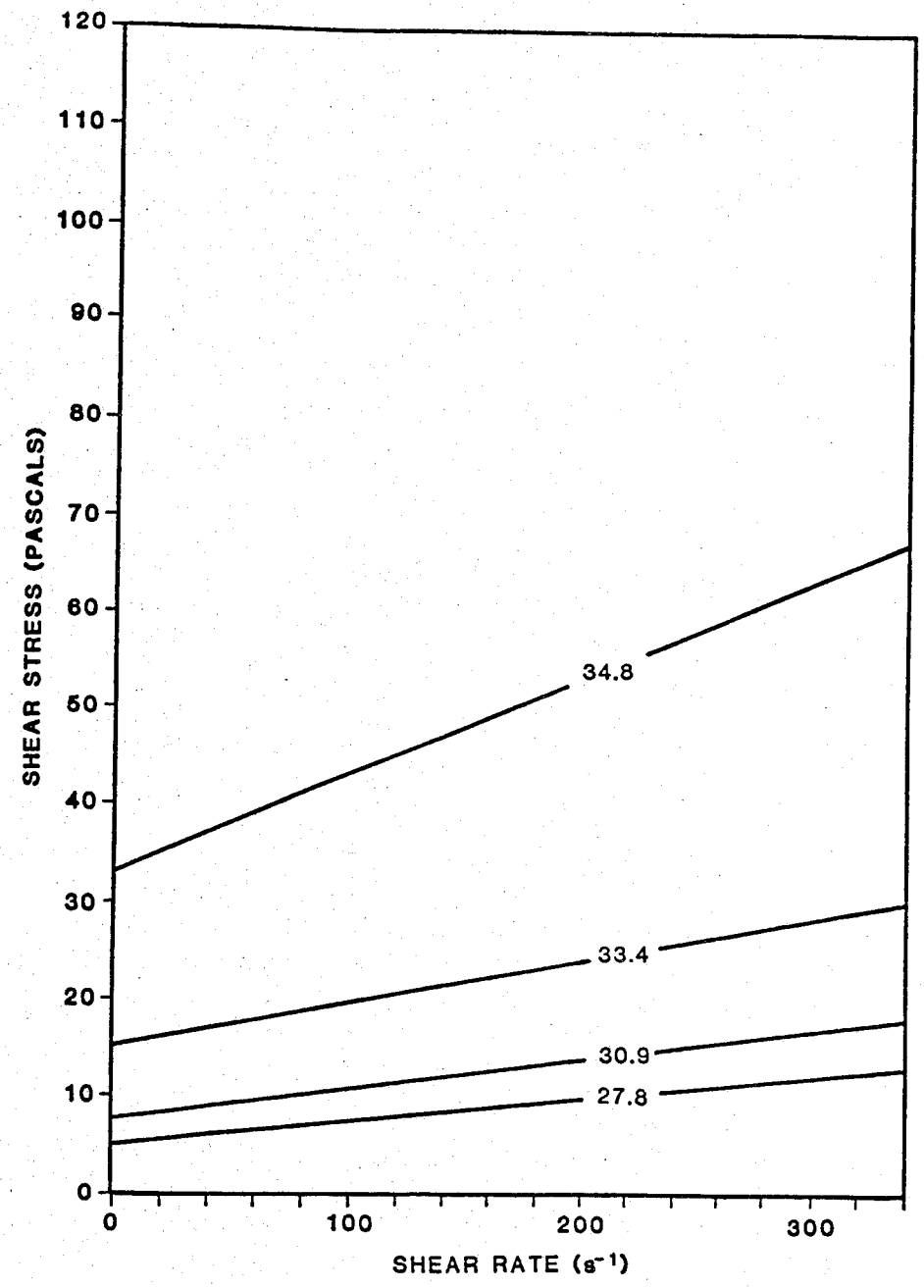
FIG. 9 is a graphical display of the effect of solids content on rheology of unwashed lignite-water mixtures formed from a first lignite sample.

As a further verification that the dissoved solids in the aqueous phase of the LWM were responsible for high viscosity, the supernatant saved from the first washing was added back to the LWM after it had been washed 26 times. This caused the suspension to again be amenable to separation by centrifugation. The viscosity of this mixture increased almost to that of the control, as shown in FIG. 8. It proved to be difficult to obtain exactly the same moisture content in both the control and the test samples. Based on the effect of solids content on rheology, shown in FIG. 9, an estimated curve for the control had it at the same solids content as that of the sample, is drawn as a dashed line in FIG. 8.

Part II—Readdition of Ions

Figure 12:
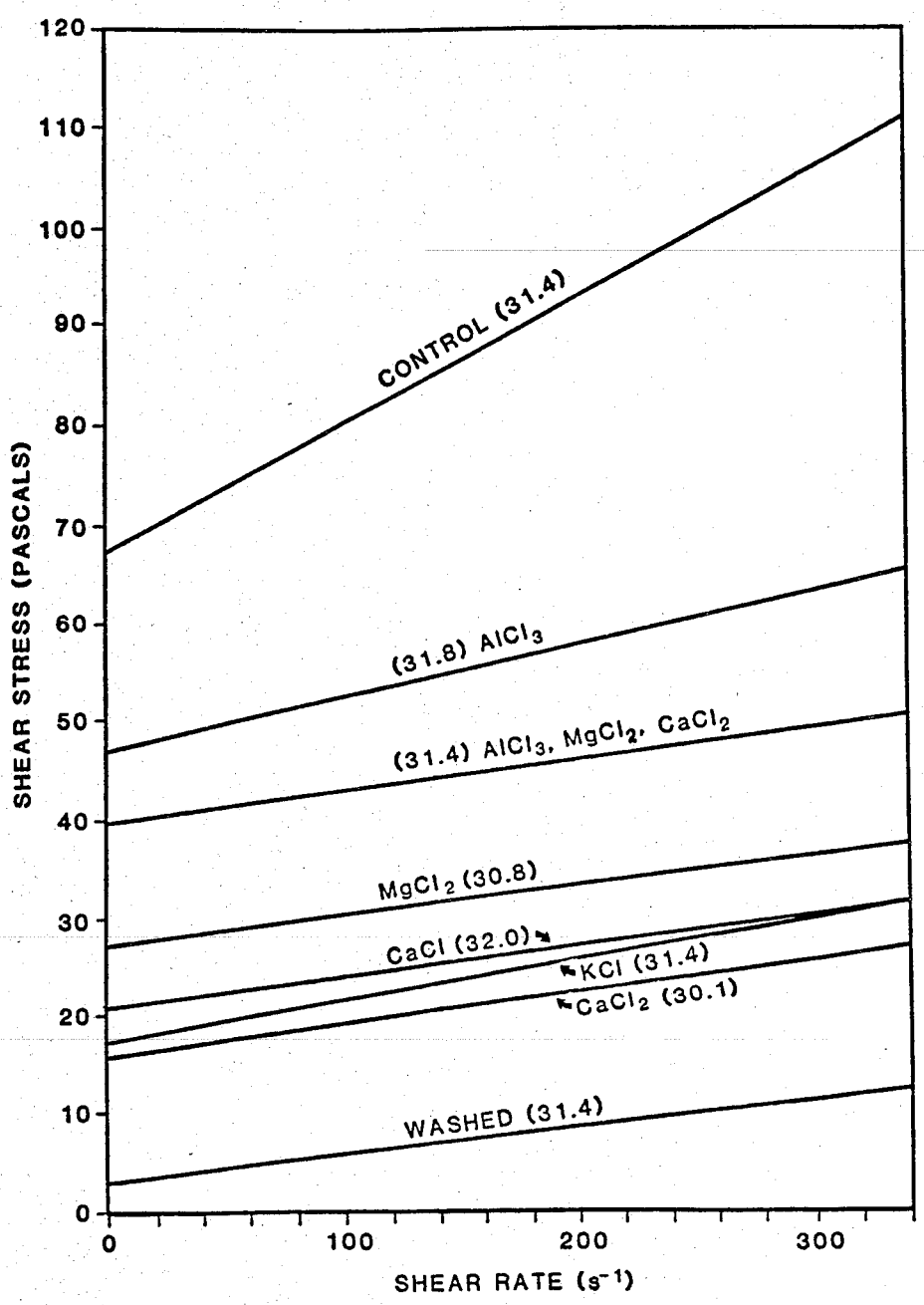
FIG. 12 is a graphical display of the effect of cations on lignite-water mixture rheology.

A second batch of lignite was ground and divided into two samples of equal size. One sample was washed until the colloidal suspension appeared (conductivity$=2.24\times10^{-4}$ mhos). The control sample remained unwashed (conductivity$=2.63\times10^{-3}$ mhos). The dramatic decrease in viscosity due to washing seen earlier with the test sample from batch one was seen again. At 10 $s^{-1}$, a value normally taken as indicative of pourability, there was a 20-fold reduction (at 34% solids) in apparent viscosity and a 10-fold decrease at 200 $s^{-1}$ (FIG. 12). Though the rheology of batch-2 also closely followed the Bingham plastic model, the yield stresses of batch-2 LWM were higher than those in batch-1 LWM. These two batches, though ground in the same manner, were from two different 10 lb. samples of the original 3-ton sample of lignite. The differences in the consistencies of the control samples from each batch were greater than the differences in consistencies of test (repeatedly washed) samples from each batch (FIGS. 8 and 12).

In order to distinguish the effect of each of the individual ions identified in Part I, a series of tests was performed. For each test of the series, a different compound (representing one of the ions identified earlier) was added to the washed (26 times) LWM in an amount sufficient to bring the conductivity up to the conductivity of the original unwashed LWM ($1.5\times10^{-3}$ mhos). The cations were added as chloride salts, since calcium sulfate is only slightly soluble. For example, $AlCl_3$ was added at ⅓ the molarity of KCl. This method allowed the cations to be changed while keeping the anion concentration ($Cl^-$) the same in each test. Aluminum chloride increased the viscosity, but not quite to that of the control (FIG. 12). Magnesium chloride produced a lesser increase, followed by calcium chloride and potassium chloride, both of which had a similar small effect on the viscosity. After individually adding the cations as $Cl^-$ compounds to the CWM, a mixture of the cations ($Al^{+++}$, $Ca^{++}$, $Mg^{++}$, and $K^+$) as chloride compounds was readded in the same proportion as identified in the supernatant from the first washing (Table 2). The total conductivity of the supernatant after the addition of the mixture was $1.5\times10^{-3}$ mhos. Reproducing the original concentrations of cations increased the viscosity but did not reproduce the original high viscosity (FIG. 12). Possibly, addition of the sulfate forms would have further increased the viscosity. On the other hand, addition of some of the other inorganic ions, e.g. $Fe^{3+}$ and $Mn^{2+}$ listed in table 2 or, perhaps addition of some unknown trace organic compound, may have been necessary for complete reversion of the test sample consistency to that of the control.

Figure 13:
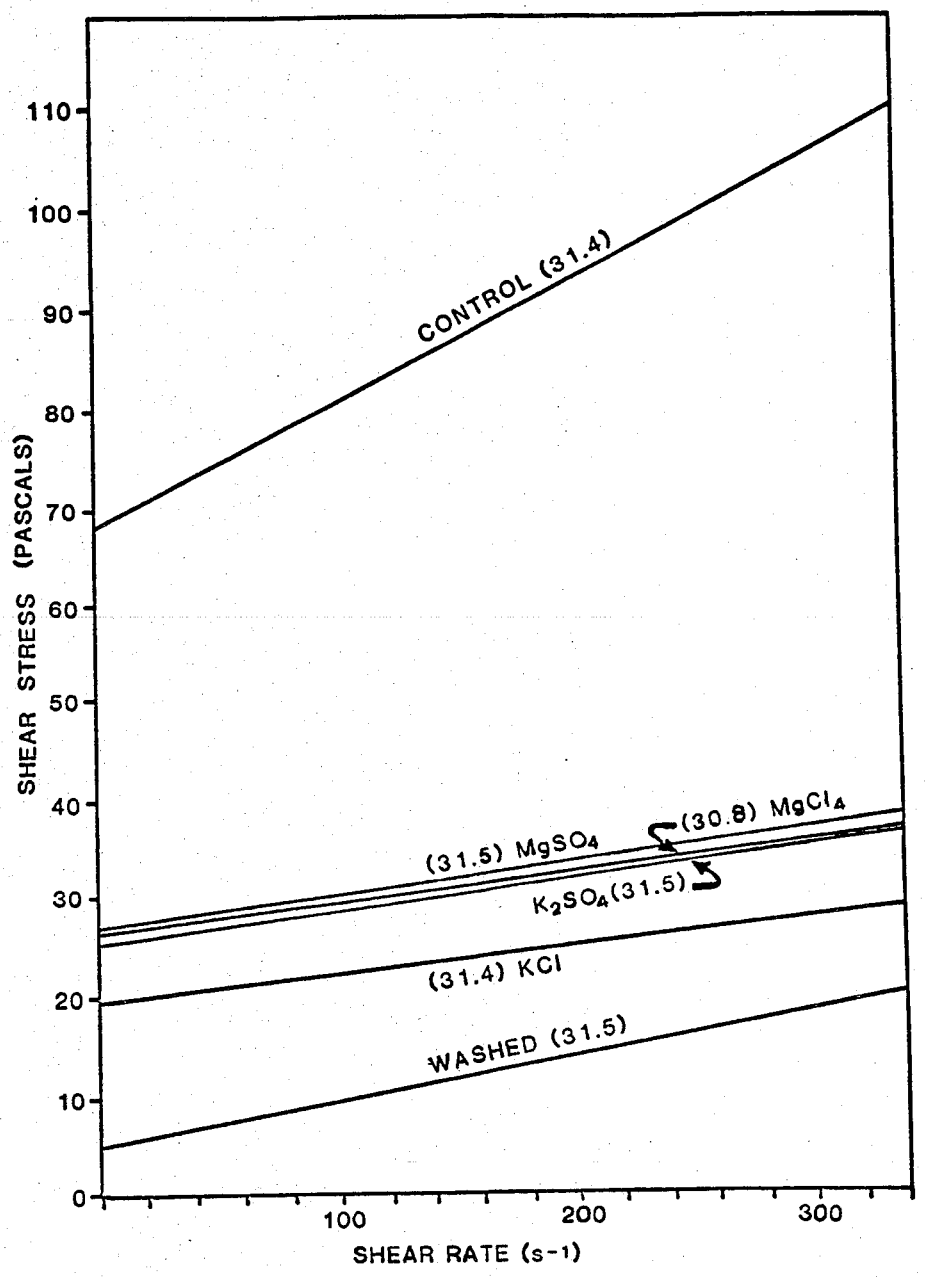
FIG. 13 is a graphical display of the effect of anions on lignite-water mixture rheology.

As previously discussed, sulfate was found to be by far the most abundant anion present in the LWM supernatant. To measure the effect of the sulfate anion on LWM rheology, the effects of $MgSO_4$, $MgCl_2$, $K_2SO_4$, and KCl and LWM rheology were compared (FIG. 13). Multiple trials to identify any differences between $Cl^-$ and $SO_4^=$ using $K_2SO_4$, KCl, $MgSO_4$and MgCl proved inconclusive (FIG. 13), since there was little difference in the rheologies of LWM to which $MgCl_2$ had been added and those to which $MgSO_4$ had been added. However, LWM to which potassium chloride had been added had a lower consistency than did the LWM to which had been added $K_2SO_4$.

The effect of the charge on the catons added to the LWM seems to follow the Schulze-Hardy rule, which states that cations of higher charge have a greater effect in destabilizing a colloidal suspension than do lower charged cations. In theory, the effect of $AlCl_3$ on stability and thus on rheology should be much greater than that of $CaCl_2$ and $MgCl_2$ which should be much greater than that of KCl. In this study the ranking was $AlCl_3 > MgCl_2 > KCl > CaCl_2$. The magnitude of the differences is masked because, as discussed earlier, the compounds were added so that the concentration of potassium was three times as great as the concentration of aluminum and twice that of magnesium or calcium. The high levels of $SO_4^=$ known to be present (Table 2) in the aqueous solution most probably precipitated some of the calcium. This would explain the smaller than expected effect of the calcium cation.

Part III—Ion Removal by Use of Ion Exchange Resins

Figure 14:
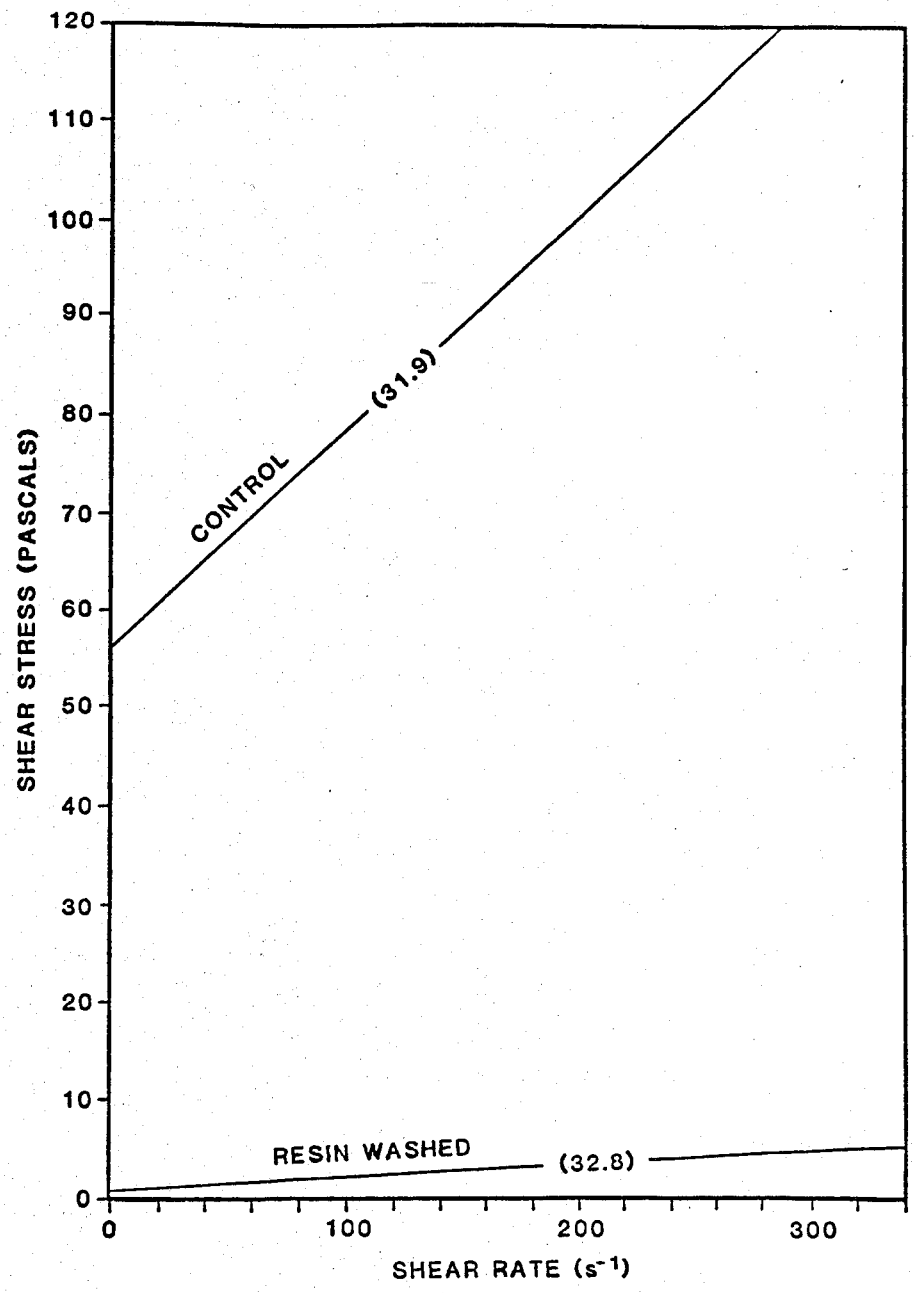
FIG. 14 is a graphical viscosity profile of the lignite-water mixture treated with ion exchange resins.

In a commercial-scale process for producing low viscosity LWM, successive washings are not practical. In Part III, ion exchange resins were employed to remove water-soluble compounds from the aqueous phase of LWM. To a freshly ground sample of lignite, cation and anion resins were successively mixed and screened as described in the procedure. The conductivity of the aqueous phase was reduced by this process from $2.31 \times 10^{-3}$ mhos to $3.67 \times 10^{-4}$ mhos, and the pH was shifted from 2.6 to 3.3. Ion exchange resin treatment produced a drastic lowering of the LWM consistency (FIGS. 12 and 14). Although the conductivity reduction was similar to that produced by washing, the consistency reduction was much more dramatic, as shown by a comparison of FIGS. 8 and 14. There was more than a 60-fold reduction in apparent viscosity at 10 $s^{-1}$ and a 30-fold drop at 200 $s^{-1}$. FIG. 15 is a flowsheet of a process using ion exchange resin to deionize LWM or CWM. The order of contact of the CWM or LWM with the type of ion exchange resin is not important. Of course, the spent resin can be regenerated many times for reuse.

SUMMARY

Figure 10:
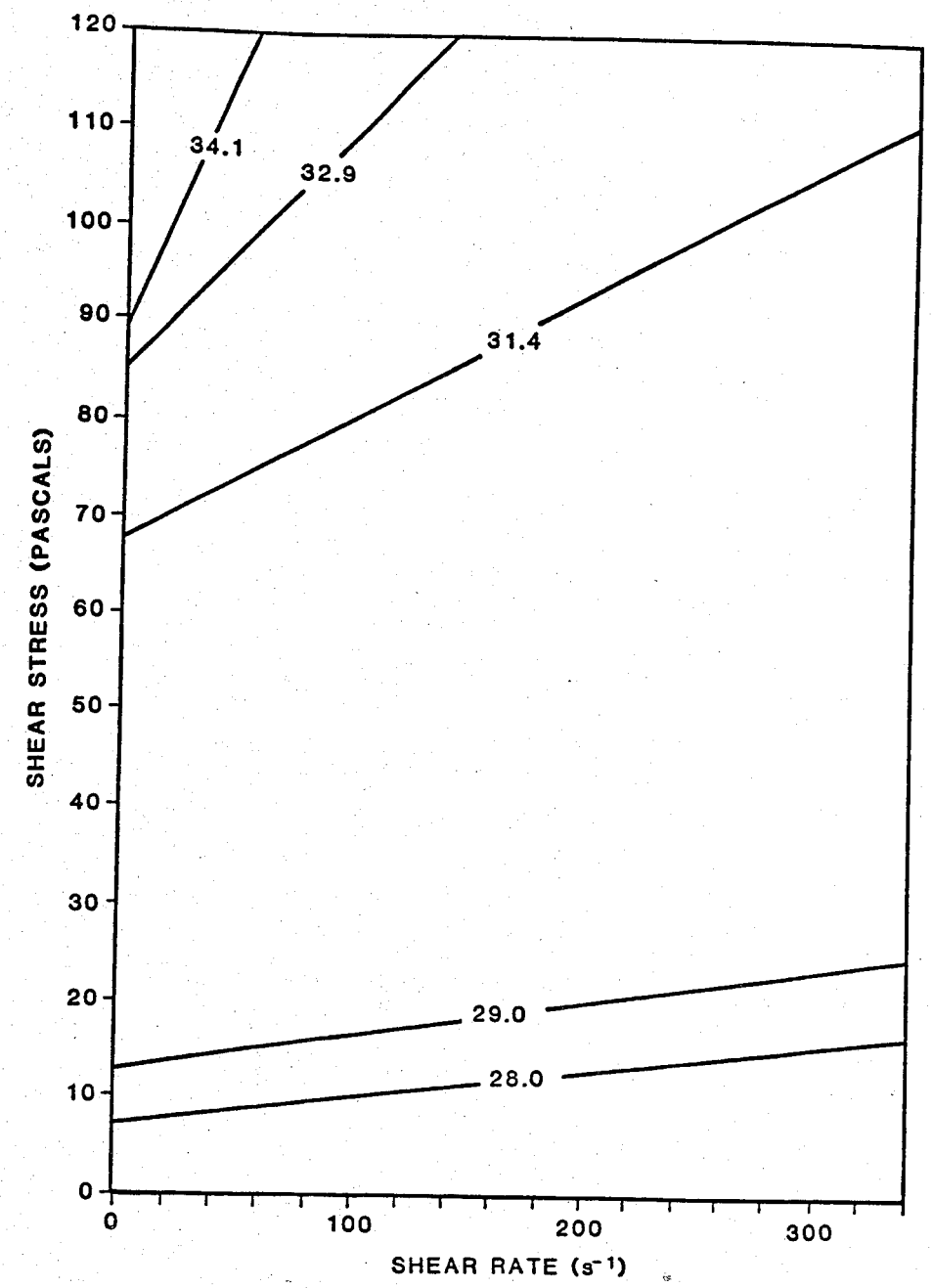
FIG. 10 is a graphical display of the effect of solids content on rheology of an unwashed lignite-water mixture formed from a second lignite sample.
Figure 11:
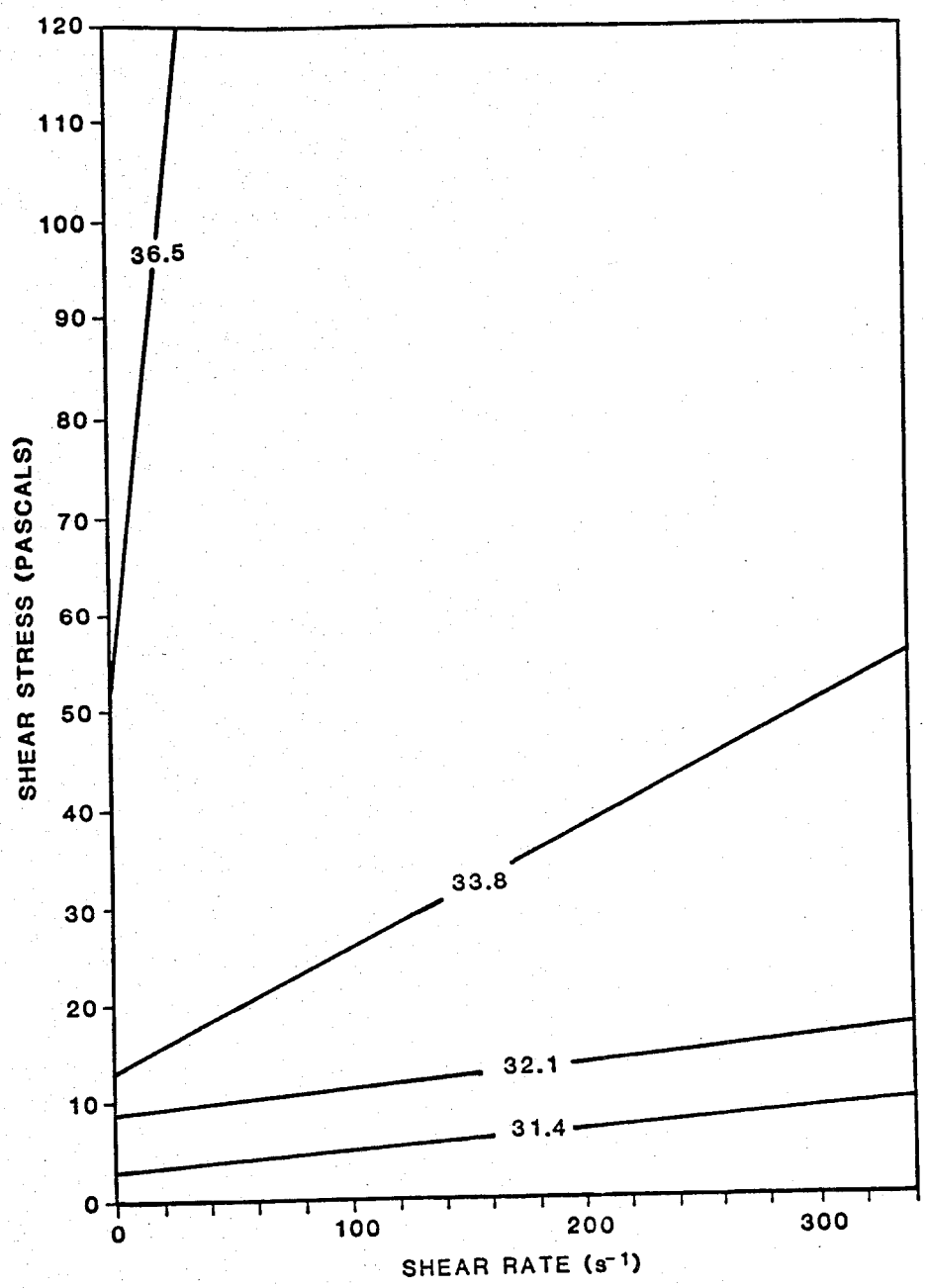
FIG. 11 is a graphical display of the effect of solids content on the lignite-water mixture of FIG. 10 after washing.

Lignite-water mixtures (LWM) containing approximately 34% solids were prepared from an Alabama lignite by wet ball milling. Lignite particle sizes in the LWM were between 5 and 60 microns. It was apparent that the rheology of the LWM studied closely followed the Bingham plastic model (FIG. 1). Repeated washing of the first LWM with deionized water brought about a seven-fold reduction in apparent viscosity at 10 $s^{-1}$ and a five-fold decrease at 200 $s^{-1}$ (FIG. 8). In the second LWM prepared, there was a twenty-fold decrease at 10 $s^{-1}$ and a ten fold decrease at 200 $s^{-1}$ (FIGS. 10 and 11). This large decrease in apparent viscosity was correlated both with a large decrease in the concentration of sulfate anion and with decreases in the concentrations of the cations calcium, magnesium, aluminum, and manganese.

A stable suspension appeared when the conductivity had been reduced by washing to less than $6 \times 10^{-4}$ mhos. The appearances of this suspension, both in batch 1 and batch 2, coincided with the greatest reduction in LWM consistency.

Allowing the mixture to stand for several days after washing allowed sufficient time for additional ions to be leached from the lignite, raising the conductivity and destabilizing the suspension. Using ion exchange resins to decrease ion concentration in the aqueous phase produced a 60-fold drop in apparent viscosity at 10 $s^{-1}$ and a decrease at 200 $s^{-1}$.

CONCLUSIONS

1. The viscosity of lignite-water slurries and suspensions can be lowered drastically by removing soluble inorganic compounds, naturally present in the lignite, from the aqueous phase of the suspension.

2. In the aqueous phase of a typical 33% solids lignite-water mixture, the following ions were found to be most abundant:

| | |
|---|---|
| $Ca^{++}$ | 546 ppm |
| $Mg^{++}$ | 419 ppm |
| $Al^{+++}$ | 76.3 ppm |
| $Mn^{++}$ | 50.0 ppm |
| $Fe^{++}/Fe^{+++}$ | 44.8 ppm |
| $SO_4^=$ | 5100 ppm |

3. The effect of the soluble ions on slurry rheology appears to be due to their influence on the interaction between lignite particles or between lignite particles and the aqueous phase, although the invention is not to be limited by this theoretical basis of operation.

4. The effects of the cations on rheology were found to be consistent with the Schulze-Hardy rule: trivalent ions had a larger effect than divalent, and divalent more than monovalent.

5. A process utilizing ion exchange resins to treat freshly prepared lignite-water mixtures by removing soluble compounds from the aqueous phase was shown to be very effective in lowering lignite-water mixture viscosity.

6. The ion exchange process can be used in concert with particle size distribution control (and possibly additives) to produce lignite-water mixtures having the lowest possible viscosities and/or the highest possible solids content.

The invention now being fully described, it will be apparent to one of ordinary skill in the art that many changes and modifications can be made thereto without departing from the spirit and scope of the invention as set forth herein.

What is claimed as new and desired to be secured by Letters Patent of the United States is:

1. A method of, lowering viscosity of a flowable carbonaceous solids-water mixture, which comprises:

contacting a particulate carbonaceous solid and water mixture, wherein sand carbonaceous solid is selected from the group cosisting of coal, lignite, and peat, comprising a solid phase and an aqueous phase, with a solid ion exchange material until the conductivity of the aqueous phase is reduced to below the level present prior to said contacting, and removing the ion exchange material from said mixture.

2. The method of claim 1, wherein said contacting continues or is repeated until the conductivity is less than $6\times10^{-4}$ mhos.

3. The method of claim 2, wherein said contacting continues or is repeated until the conductivity is less than $3\times10^{-4}$ mhos.

4. The method of claim 1, wherein said ion exchange material is a cation exchange material capable of exchanging hydrogen ions for positively charged ions in said mixture.

5. The method of claim 4, wherein said cation exchange material is a sulfonated copolymer of styrene and divinylbenzene.

6. The method of claim 1, wherein said ion exchange material is an anion exchange material capable of exchanging hydroxide ions for negatively changed ions in said mixture.

7. The method of claim 6, wherein said anion exchange material comprises quaternary amine hydroxide functional groups.

8. The method of claim 1, wherein said ion exchange material comprises both an anion exchange material and a cation exchange material.

9. The method of claim 8, wherein said cation exchange material and said anion exchange material are contacted simultaneously with said mixture.

10. The method of claim 8, wherein said cation exchange material and said anion exchange material are contacted sequentially with said mixture.

11. The method of claim 1, wherein said ion exchange material is a particulate resin having a particle size larger than the average maximum particle size of said particulate carbonaceous solid.

12. The method of claim 1, wherein said carbonaceous solid is coal.

13. The method of claim 1, wherein said carbonaceous solid is lignite.

14. The method of claim 1, wherein said mixture is produced in the absence of dispersants or suspending agents.

15. The method of claim 1, wherein a mixture is produced solely by said contacting and separating.

16. The method of claim 1, wherein multivalent ions are preferably removed from said aqueous phase.

17. The method of claim 1, wherein the solids content of said mixture is no more than 80%.

18. The method of claim 1, wherein the solids content of said mixture is at least 32%.

19. The method of claim 17, wherein the solids content of said mixture is at least 50%.

20. The method of claim 17, wherein the solids content of said mixture is at least 65%.

* * * * *

UNITED STATES PATENT AND TRADEMARK OFFICE

CERTIFICATE OF CORRECTION

PATENT NO. : 4,652,270

DATED : March 24, 1987

INVENTOR(S) : LEON Y. SADLER, III

It is certified that error appears in the above-identified patent and that said Letters Patent is hereby corrected as shown below:

Title page, in the abstract, line 5, change "unit" to --until--.

Column 5, line 3 change "monovalent $SO_4^{4-}$" to --monovalent. $SO_4^{4-}$--.

Column 11, line 27, change "dionex" to --Dionex--;

line 33, delete "and ½"", first occurrence;

line 59, change "was" to --were--.

Column 15, line 11 change "catons" to --cations--.

Column 16, line 59 before "lowering" delete ",".

Signed and Sealed this

Eighth Day of September, 1987

*Attest:*

DONALD J. QUIGG

*Attesting Officer*

*Commissioner of Patents and Trademarks*